US011276964B2

(12) United States Patent
Zhu

(10) Patent No.: US 11,276,964 B2
(45) Date of Patent: Mar. 15, 2022

(54) CONNECTOR ASSEMBLY

(71) Applicant: HYC CO., LTD., Qingyuan (CN)

(72) Inventor: Lei Zhu, Qingyuan (CN)

(73) Assignee: HYC CO., LTD, Qingyuan (CN)

( * ) Notice: Subject to any disclaimer, the term of this patent is extended or adjusted under 35 U.S.C. 154(b) by 0 days.

(21) Appl. No.: 16/883,440

(22) Filed: May 26, 2020

(65) Prior Publication Data

US 2020/0381864 A1 Dec. 3, 2020

(30) Foreign Application Priority Data

May 28, 2019 (CN) ..... 201910451276.4

(51) Int. Cl.

| | |
|---|---|
| ***H01R 13/633*** | (2006.01) |
| ***H01R 13/506*** | (2006.01) |
| ***H01R 13/52*** | (2006.01) |
| ***H01R 13/627*** | (2006.01) |
| ***H01R 13/639*** | (2006.01) |

(52) U.S. Cl.

CPC ..... *H01R 13/633* (2013.01); *H01R 13/506* (2013.01); *H01R 13/5213* (2013.01); *H01R 13/6278* (2013.01); *H01R 13/639* (2013.01)

(58) Field of Classification Search

CPC .. H01R 42/26; H01R 13/6335; H01R 13/633; H01R 13/506; H01R 13/5213; H01R 13/6278; H01R 13/639

See application file for complete search history.

(56) References Cited

U.S. PATENT DOCUMENTS 6,447,170 B1 * 9/2002 Takahashi ..... H01R 13/6273 385/53
6,491,542 B1 12/2002 Zerebilov
7,371,107 B2 * 5/2008 Deng ..... H01R 12/716 439/491

(Continued)

FOREIGN PATENT DOCUMENTS

CN 202564689 U 11/2012
CN 105723572 A 6/2016

(Continued)

OTHER PUBLICATIONS

Combined Search & Examination Report (GB 2008018.0), dated Nov. 17, 2020.
Int'l Search Report (PCT/CN2019/098573), dated Mar. 6, 2020.

*Primary Examiner* — Tho D Ta
(74) *Attorney, Agent, or Firm* — Hunton AK LLP

(57) ABSTRACT

Disclosed is a connector assembly. The connector assembly includes a first component, a second component and a locking assembly. The first component includes an inner housing and an outer housing. The outer housing is sleeved on the inner housing. The second component is configured to engage with the first component in a snap-fit way. The outer housing is movable relative to the inner housing so that the second component is disengageable from the first component. The locking assembly includes a locking groove on one of the inner housing and the outer housing, and a locking hook on the other one of the inner housing and the outer housing, so that the outer housing is secured to the inner housing, and thereby, the first component cannot be disengaged from the second component.

5 Claims, 12 Drawing Sheets

(56) References Cited

U.S. PATENT DOCUMENTS

| | | | | |
|---|---|---|---|---|
| 7,534,132 | B2 * | 5/2009 | Kuo | H01R 13/5045 220/796 |
| 9,967,993 | B1 * | 5/2018 | Walker | H05K 7/1418 |
| 2003/0008557 | A1 | 1/2003 | Suzuki | |
| 2003/0211785 | A1 | 11/2003 | Fujita et al. | |
| 2013/0230999 | A1 * | 9/2013 | Saitoh | H01R 13/639 439/304 |
| 2016/0126660 | A1 * | 5/2016 | Henry | H01R 13/5845 439/606 |
| 2016/0254611 | A1 | 9/2016 | Mott et al. | |
| 2018/0159289 | A1 * | 6/2018 | Krupp | H01R 43/26 |
| 2019/0027866 | A1 * | 1/2019 | Wu | H01R 13/6335 |
| 2019/0321950 | A1 * | 10/2019 | Twomey | B25B 27/02 |

FOREIGN PATENT DOCUMENTS

| | | | |
|---|---|---|---|
| CN | 205863534 | U | 1/2017 |
| CN | 208607390 | U | 3/2019 |
| CN | 110061387 | A | 7/2019 |
| CN | 209675601 | U | 11/2019 |
| EP | 3066724 | B1 | 9/2016 |
| WO | 2018156376 | A1 | 8/2018 |

* cited by examiner

CONNECTOR ASSEMBLY

CROSS-REFERENCE TO RELATED APPLICATION

This application claims priority to a Chinese patent application No. 201910451276.4 filed on May 28, 2019, disclosure of which is incorporated herein by reference in its entirety.

TECHNICAL FIELD

The present disclosure relates to the technical field of connectors and, in particular, to a connector assembly.

BACKGROUND

A connector assembly is generally used to connect two optical components or electrical components to transmit optical signals or electrical signals. The connector assembly includes two components detachably connected. The two components are disposed on the two optical components or the two electric components so that the two optical components or the two electric components are detachably connected.

The two components of the connector assembly are detachably connected in a snap-fit way. One component includes an inner housing and an outer housing that are movable relative to each other. The inner housing is provided with a snap-fit groove. The other component includes a snap-fit hook. The snap-fit hook engages with the snap-fit groove in a snap-fit way so that the connection of the connector assembly is implemented. The snap-fit hook is disengaged from the snap-fit groove in response to direct pulling by an external force so that the disconnection of the connector assembly is implemented.

Currently, the connector assembly is not available to the connection occasions with high safety performance requirements. Operators or other irrelevant personnel can disassemble the connector assembly at will. However, if the connector assembly is disassembled and disconnected by the irrelevant personnel, it is easy to cause unexpected consequences in the environment with high safety level requirements.

Therefore, there is an urgent need for a connector assembly to solve the preceding problem.

SUMMARY

The object of the present disclosure is to provide a connector assembly that can be applied to connection occasions with high safety performance requirements and avoid being disassembled and disconnected by irrelevant personnel, thereby reducing potential safety hazards.

To implement the preceding object, the technical solutions described below are provided.

A connector assembly is provided. The connector assembly includes a first component and a second component. The first component includes an inner housing and an outer housing. The outer housing is sleeved on the inner housing. The second component is configured to engage with the first component in a snap-fit way. The outer housing is movable relative to the inner housing so that the second component is disengageable from the first component. The connector assembly further includes a locking assembly.

The locking assembly includes a locking groove on one of the inner housing and the outer housing, and a locking hook on the other one of the inner housing and the outer housing. The locking hook can engage with the locking groove in a snap-fit way to secure the outer housing to the inner housing.

Further, the connector assembly also includes an unlocking member. The unlocking member is configured to disengage the locking hook from the locking groove.

Further, the outer housing is provided with a locking arm. The locking hook is secured to a free end of the locking arm.

Further, the unlocking member is provided with an unlocking arm. The unlocking arm is configured to be inserted between the outer housing and the inner housing and abut against the locking arm so as to prop the locking arm open to disengage the locking hook from the locking groove.

Further, the unlocking arm is provided with a first ramp. The first ramp is configured to abut against the locking arm.

Further, the unlocking member is provided with an engaging protrusion, and the outer housing is provided with a receiving groove. The engaging protrusion is configured such that when the engaging protrusion engages with the receiving groove, the locking arm can prop the locking arm open to disengage the locking hook from the locking groove.

Further, the unlocking member is provided with a first identifier, and the outer housing is provided with a second identifier. The first identifier is identical to the second identifier, or the first identifier can match the second identifier.

Further, the connector assembly also includes a dust cap. The dust cap is provided with a second snap-fit groove. The second component is provided with a snap-fit hook. The second snap-fit groove is configured to engage with the snap-fit hook of the second component in a snap-fit way so as to secure the dust cap to the second component.

Further, the dust cap is provided with an unlocking groove. The unlocking arm is configured to be inserted into the unlocking groove and abut against the snap-fit hook so as to disengage the snap-fit hook from the second snap-fit groove.

Further, the unlocking arm is provided with a second ramp. The second ramp is configured to abut against the snap-fit hook so as to disengage the snap-fit hook from the second snap-fit groove.

Compared with the related art, the present disclosure has the beneficial effects described below.

The connector assembly provided in the present disclosure includes a first component, a second component and a locking assembly. The first component includes an inner housing and an outer housing. The outer housing is sleeved on the inner housing. The second component is configured to engage with the first component in a snap-fit way. The outer housing is movable relative to the inner housing so that the second component is disengageable from the first component. The locking assembly includes a locking groove on one of the inner housing and the outer housing, and a locking hook on the other one of the inner housing and the outer housing, so that the outer housing is secured to the inner housing, and thereby, the first component cannot be disengaged from the second component. The connector assembly provided in the present disclosure can be applied to connection occasions with high safety performance requirements and avoid being disassembled and disconnected by irrelevant personnel, thereby reducing potential safety hazards.

BRIEF DESCRIPTION OF DRAWINGS

To illustrate the technical solutions in the embodiments of the present disclosure more clearly, the accompanying drawings used in description of the embodiments will be described below. Apparently, the accompanying drawings described below illustrate only part of embodiments of the present disclosure, and those skilled in the art can obtain other accompanying drawings on the basis of the accompanying drawings and the embodiments described below without creative work.

REFERENCE LIST

Figure 1:
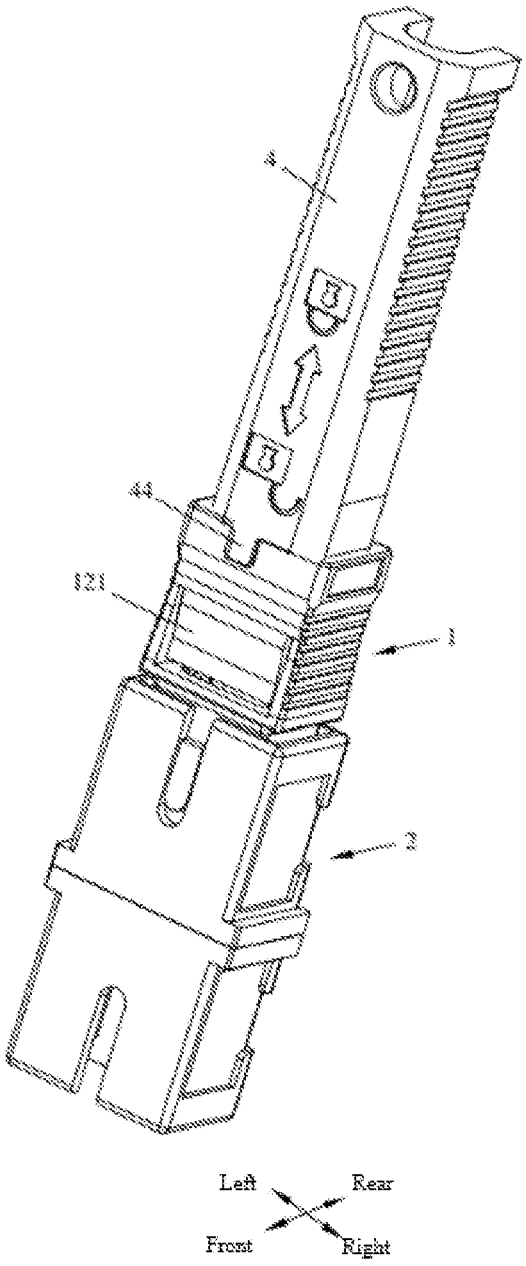
FIG. 1 is a schematic structure view of a connector assembly according to the present disclosure.

1 first component
11 inner housing
111 first snap-fit groove
12 outer housing
121 locking arm
1211 protrusion
122 boss
123 receiving groove
13 core
131 plug
132 secured end
2 second component
21 snap-fit hook
22 jack
23 cantilever
31 locking groove
32 locking hook
4 unlocking member
41 unlocking arm
42 first ramp
43 second ramp
44 engaging protrusion;
5 dust cap
51 second snap-fit groove
52 unlocking groove

DETAILED DESCRIPTION

For better understanding of the technical solutions of the present disclosure by those skilled in the art, the technical solutions of the present disclosure will be described below in conjunction with the accompanying drawings and the embodiments.

In the description of the present disclosure, it is to be noted that the orientational or positional relationships indicated by terms "above", "below", "left", "right", "vertical", "horizontal", "inside", "outside", "front", "rear" and the like are based on the orientational or positional relationships illustrated in the drawings or the orientational or positional relationship in which products of the present disclosure are usually placed during use. These orientational or positional relationships are for the mere purpose of facilitating and simplifying the description of the present disclosure and do not indicate or imply that the apparatus or element referred to has a specific orientation and is constructed and operated in a specific orientation. Thus, these orientational or positional relationships shall not be construed as limiting the present disclosure.

Additionally, terms "first", "second", "third" and the like in the present disclosure are only used to distinguish component names for ease of description and cannot indicate a priority order.

Figure 2:
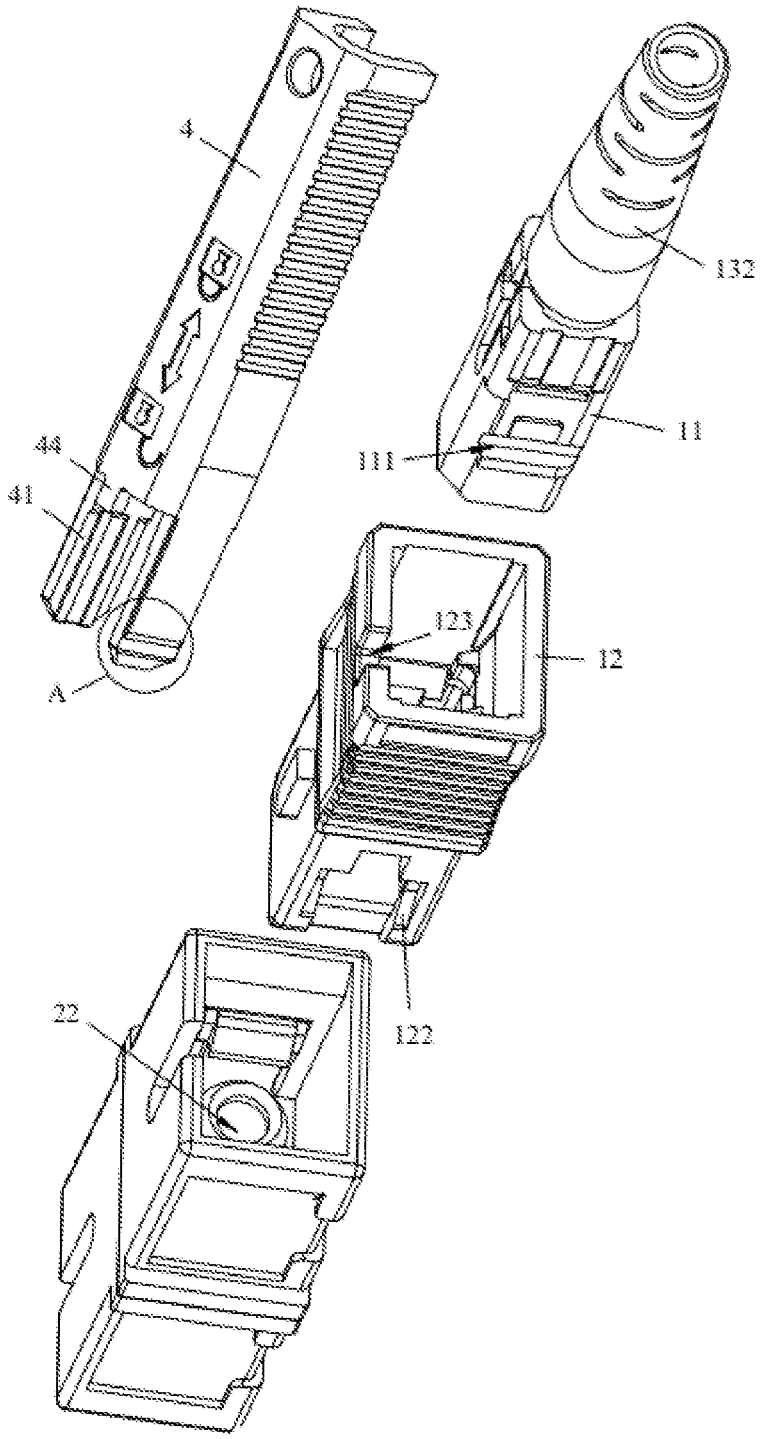
FIG. 2 is an exploded schematic view of the connector assembly according to the present disclosure.

A connector assembly is generally used to connect two optical components or electrical components to transmit optical signals or electrical signals. As shown in FIGS. 1 to 2, the connector assembly includes a first component 1 and a second component 2. The two components are detachably connected in a snap-fit way so that the two electrical components or the two optical components are detachably connected. The connector assembly provided in this embodiment may be an optical fiber connector assembly, an electrical connector assembly or the like. The first component 1 may be a connector. The second component 2 may be an adapter fitting the connector.

It is to be noted that as shown in FIG. 1, for ease of description, "from top to bottom" refers to a direction along which the first component 1 gradually move to be inserted into the second component 2. Similarly, "from bottom to top" refers to a direction along which the first component 1 gradually moves to be disengaged from the second component 2. "Front" refers to a visible front surface of the first component 1 or the second component 2 in FIG. 1. "Rear" refers to an invisible surface of the first component 1 or the second component 2 in FIG. 1 opposite the "front". "Left" refers to an invisible left surface in FIG. 1. "Right" refers to a visible surface opposite the "left" in FIG. 1.

Figure 3:
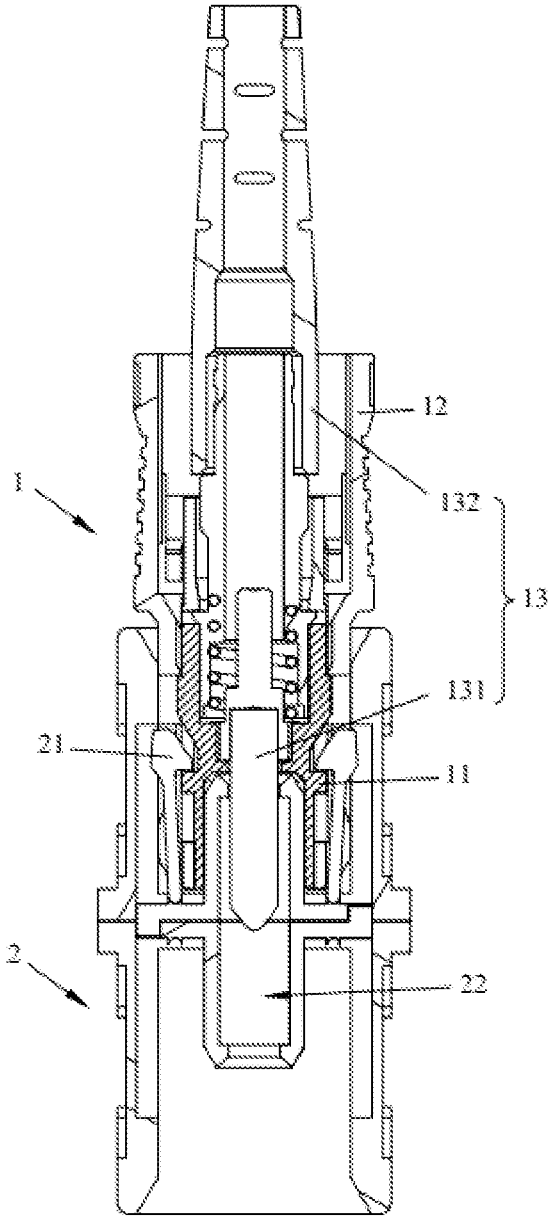
FIG. 3 is a cross-sectional view of a first component assembled with a second component according to the present disclosure.

As shown in FIG. 3, a description is given below using an example in which the first component 1 is a connector with a plug 131 and the second component 2 is an adapter with a jack 22.

Exemplarily, the first component 1 includes a core 13. One end of the core 13 is the plug 131. The other end of the core 13 is a secured end 132. The plug 131 can be inserted into the jack 22 of the second component 2. The secured end 132 is configured to be secured to one electrical component.

Figure 4:
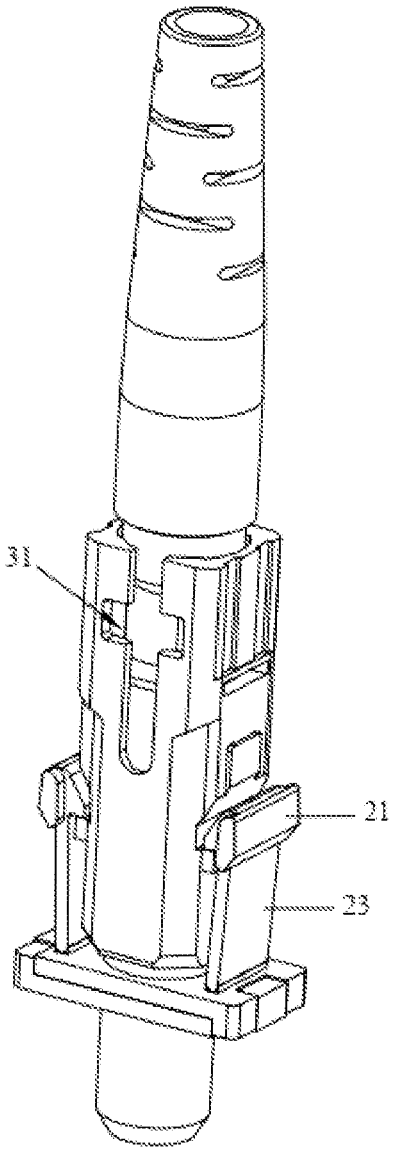
FIG. 4 is a schematic structure view of a snap-fit hook engaging with a first snap-fit groove in a snap-fit way according to the present disclosure.
Figure 5:
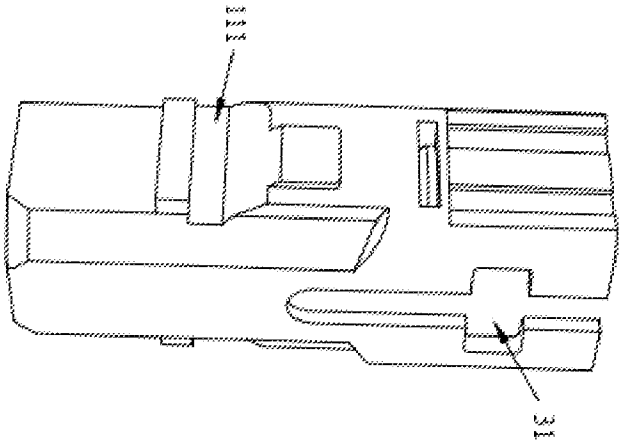
FIG. 5 is a schematic structure view of an inner housing according to the present disclosure.

Alternatively, as shown in FIGS. 3 to 5, the first component 1 further includes an inner housing 11. The inner housing 11 is provided with a first snap-fit groove 111. The second component 2 is provided with a snap-fit hook 21. When the plug 131 of the first component 1 is inserted into the jack 22 of the second component 2, the snap-fit hook 21 of the second component 2 can engage with the first snap-fit groove 111 of the first component 1 in a snap-fit way so that the first component 1 is connected to the second component 2.

Figure 6:
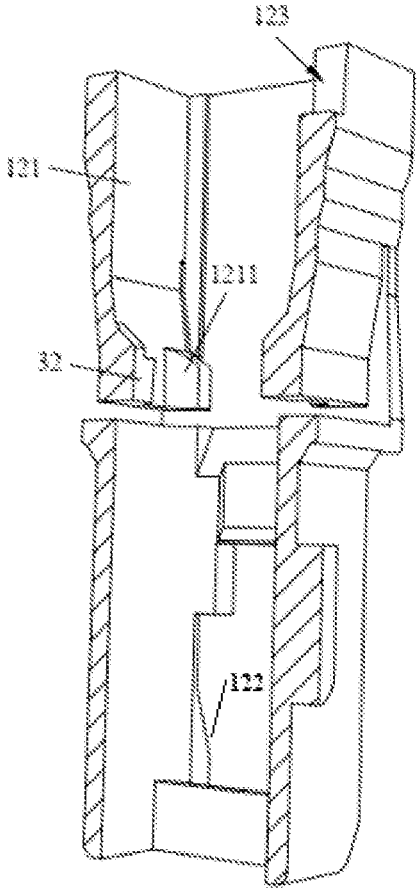
FIG. 6 is a cross-sectional view of an outer housing according to the present disclosure.

Further, as shown in FIG. 6 in conjunction with FIG. 2, the first component 1 further includes an outer housing 12.

The outer housing 12 is sleeved on the inner housing 11 and movable relative to the inner housing 11. The outer housing 12 is provided with a notch at a position corresponding to the first snap-fit groove 111 on the inner housing 11 to ensure that the snap-fit hook 21 of the second component 2 can engage with the first snap-fit groove 111 in a snap-fit way.

Additionally, two sides of the notch of the outer housing 12 are each provided with a boss 122. An upper surface of each boss 122 is a ramp. The second component 2 is provided with a cantilever 23. The snap-fit hook 21 is disposed at a free end of the cantilever 23. The ramp can abut against the snap-fit hook 21 on an inner side of the cantilever 23 so as to prop the cantilever 23 open to disengage the snap-fit hook 21 from the first snap-fit groove 111.

Specifically, the ramp has a gradually increased height from top to bottom. When the outer housing 12 moves upward in response to an external force, the ramp can abut against the snap-fit hook 21 on the inner side of the cantilever 23 of the second component 2. The outer housing 12 keeps moving upward so that the ramp props the cantilever 23 open and the snap-fit hook 21 is disengaged from the first snap-fit groove 111.

In short, when a connection is required, the first component 1 is inserted into the second component 2, and the snap-fit hook 21 on the cantilever 23 of the second component 2 engages with and is locked into the first snap-fit groove 111 of the first component 1, so that the connector assembly is assembled. When a disconnection is required, the outer housing 12 is pulled directly. Since the snap-fit groove 111 on the inner housing 11 is locked to the snap-fit hook 21, the inner housing 11 is unmovable, while the outer housing 12 is movable relative to the inner housing 11 in response to an external force, so that the ramp on the outer housing 12 abuts against the bottom of the snap-fit hook 21, and props the cantilever 23 open when the outer housing 12 moves upward to disengage the snap-fit hook 21 from the first snap-fit groove 111. In this way, the two components are disassembled and disconnected.

Exemplarily, the first component 1 and the second component 2 are each prismatic. Alternatively, the second component 2 may be provided with two snap-fit hooks 21. The two snap-fit hooks are provided on two opposite sides of the second component 2. Two cantilevers 23 with the two snap-fit hooks 21 are symmetrically disposed on a left surface and a right surface inside the second component 2. Two first snap-fit grooves 111 are symmetrically disposed on a left surface and a right surface of the inner housing 11. Two notches are symmetrically disposed on a left surface and a right surface of the outer housing 12. Accordingly, two sides of each notch are each provided with a boss 122 with a ramp.

Alternatively, the first snap-fit groove 111 and the snap-fit hook 21 has a flat abutting surface, which improves the snap-fit effect between the first snap-fit groove 111 and the snap-fit hook 21.

Figure 7:
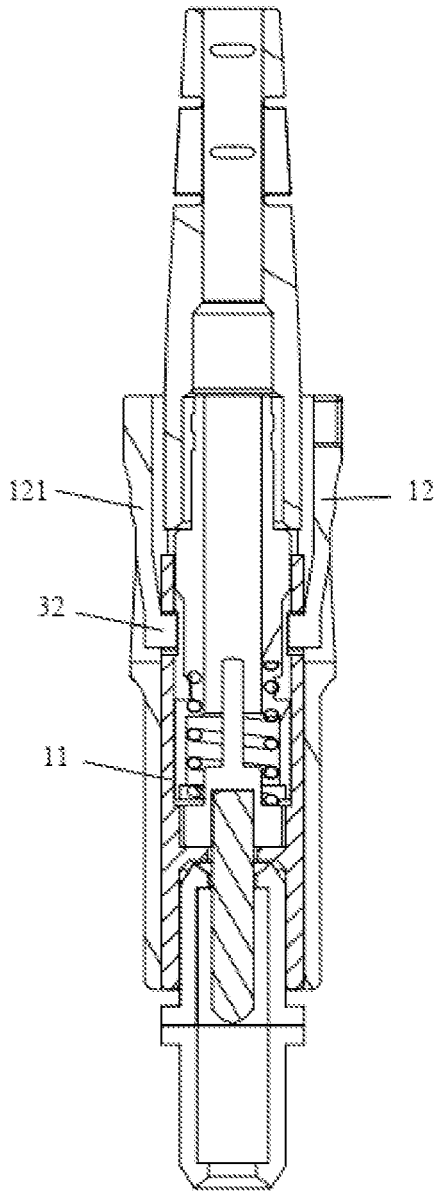
FIG. 7 is a cross-sectional view of the outer housing locked to the inner housing according to the present disclosure.

As shown in FIG. 7, alternatively, to improve the safety of the connector assembly and prevent irrelevant personnel from disengaging the first component 1 from the second component 2 in response to pulling, the connector assembly further includes a locking assembly. The locking assembly includes a locking groove 31 on the inner housing 11, and a locking hook 32 on the outer housing 12. The locking hook 32 can engage with the locking groove 31 in a snap-fit way to secure the outer housing 12 to the inner housing 11, thereby preventing the outer housing 12 from moving relative to the inner housing 11, so that the ramp on the outer housing 12 cannot prop the cantilever 23 with the snap-fit hook 21 open. Thus, the first component 1 is prevented from being disengaged from the second component 2 in response to only pulling the first component 1. In other embodiments, the locking groove 31 may be disposed on the outer housing 12, and the locking hook 32 may be disposed on the inner housing 11. The locking hook 32 can engage with the locking groove 31 in a snap-fit way to secure the outer housing 12 to the inner housing 11 so that the preceding effect can also be achieved.

The connector assembly provided in this embodiment can be applied to connection occasions with high safety performance requirements and avoid being disassembled and disconnected by irrelevant personnel, thereby reducing potential safety hazards.

Figure 8:
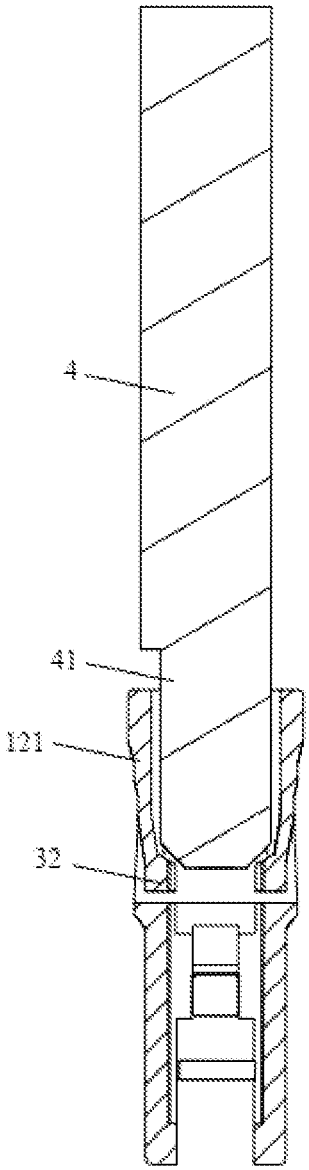
FIG. 8 is a schematic structure view of an unlocking member according to the present disclosure.

Optionally, as shown in FIG. 8 in conjunction with FIG. 2, to release the locking mode so that a specific operator can pull the first component 1 out of the second component 2, the connector assembly further includes an unlocking member 4. The unlocking member 4 is configured to disengage the locking hook 32 from the locking groove 31 so that the outer housing 12 is movable relative to the inner housing 11 in response to an external force, and thereby, the first component 1 is disengaged from the second component 2.

Optionally, the outer housing 12 is provided with a locking arm 121, and the locking hook 32 is secured to a free end of the locking arm 121. Such configuration helps assemble the outer housing 12 and the inner housing 11. It is to be noted that one end of the locking arm 121 is connected to the outer housing 12, and the other end of the locking arm 121 is a free end. In short, the locking arm 121 is a cantilever structure, and the free end of the locking arm 121 can swing within a certain range in response to an external force, so that the locking hook 32 can engage with the locking groove 31 in a snap-fit way or disengaged from the locking groove 31.

Specifically, two locking arms 121 are disposed on a front surface and a rear surface of the outer housing 12, respectively, two locking grooves 31 are disposed on a front surface and a rear surface of the inner housing 11, respectively, and the respective locking arm 121 can swing in the front direction and the rear direction, so that the locking hook 32 at the free end of the respective locking arm 121 is disengageable from the locking groove 31 on the inner housing 11.

Optionally, the unlocking member 4 is further provided with a guide channel. When the unlocking member 4 unlocks, the secured end 132 of the core 13 of the first component 1 is received in the guide channel so that the unlocking member 4 moves to between the inner housing 11 and the outer housing 12 of the first component 1 along the direction of the guide channel to unlock.

Specifically, the guide channel is a U-shaped semi-enclosed channel to fit different sizes of secured ends 132.

Figure 9:
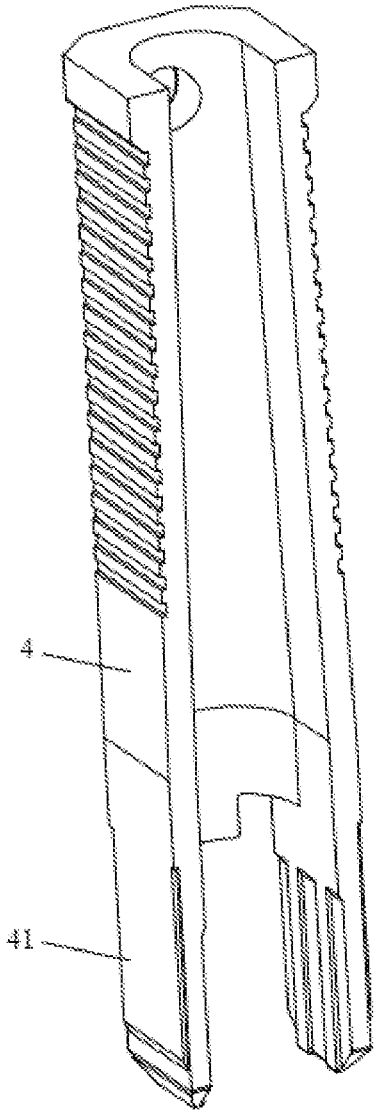
FIG. 9 is a cross-sectional view of the unlocking member in unlocking according to the present disclosure.

Optionally, as shown FIG. 9, the unlocking member 4 is provided with an unlocking arm 41. The unlocking arm 41 is configured to be inserted between the outer housing 12 and the inner housing 11 and abut against the locking arm 121 so as to prop the locking arm 121 open to disengage the locking hook 32 from the locking groove 31.

Figure 10:
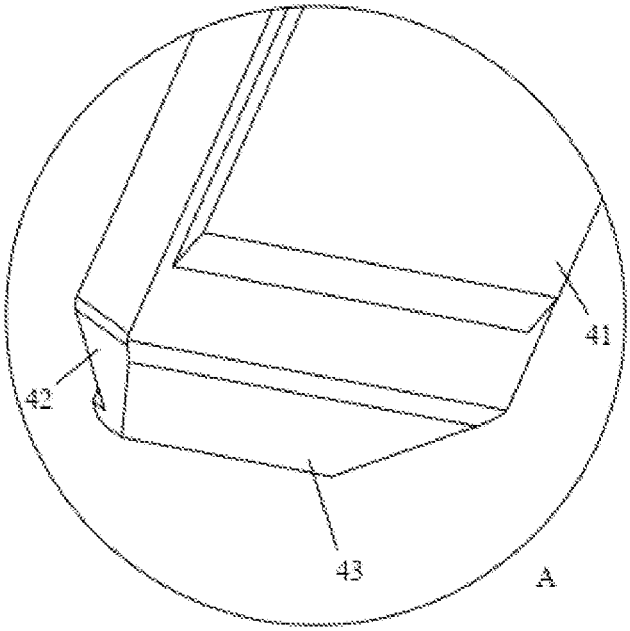
FIG. 10 is a partial enlarged view of part A of FIG. 2.

Optionally, as shown in FIG. 10 in conjunction with FIG. 2, the unlocking arm 41 is provided with a first ramp 42. The first ramp 42 is configured to abut against the locking arm 121.

Specifically, the unlocking arm 41 has a trapezoidal end. Two sides of the end of the unlocking arm 41 are each provided with the first ramp 42. Two first ramps 42 abut against the two locking arms 121, respectively. When the unlocking member 4 moves downward, the two first ramps 42 can push the two locking arms 121 to expand the two locking arms 121 outward, thus disengaging the locking hooks 32 from the corresponding locking grooves 31.

In this embodiment, the two locking arms 121 are symmetrically disposed on the front surface and the rear surface of the outer housing 12. Each locking arm 121 has a certain width. Two ends of each locking arm 121 are provided with two protrusions 1211. Each protrusion 1211 can abut against the unlocking arm 41. Each protrusion 1211 and the unlocking arm 41 have a ramped abutting surface so that the unlocking arm 41 can push the two locking arms 121 open.

Further, the two unlocking arms 41 are symmetrically disposed on two sides of the unlocking member 4. Two first ramps 42 on one unlocking arm 41 abut against one end of one locking arm 121 and one end of the other locking arm 121, respectively. Two first ramps 42 on the other unlocking arm 41 abut against the other end of the one locking arm 121 and the other end of the other locking arm 121, respectively. In this way, two ends of each locking arm 121 are uniformly stressed so that the each locking arm 121 has more stable movement.

Optionally, in order that a specific unlocking member 4 can unlock only a first component 1 that matches the specific unlocking member 4, the unlocking member 4 is provided with an engaging protrusion 44, and the outer housing 12 of the first component 1 is provided with a receiving groove 123. The engaging protrusion 44 is configured such that when the engaging protrusion 44 engages with the receiving groove 123, the locking arm 41 can prop the locking arm 121 open to disengage the locking hook 32 from the locking groove 31.

Specifically, only when the engaging protrusion 44 on the unlocking member 4 engages with the receiving groove 123 on the outer housing 12, can the downward movement amount of the unlocking arm 41 enable the unlocking arm 41 to prop the locking arm 121 open to disengage the locking hook 32 from the locking groove 31. Therefore, this design allows an unlocking member 4 to unlock only a first component 1 that matches the unlocking member 4, thus preventing irrelevant personnel from disconnecting the connector assembly at will.

In other embodiments, there may be multiple engaging protrusions 44, which may be specifically designed as needed and will not be illustrated here.

Optionally, the unlocking member 4 and the outer housing 12 are provided with identical identifiers so that the matching unlocking member 4 can be quickly selected according to the identifier of the outer housing 12. In other embodiments, the unlocking member 4 may be provided with a first identifier, the outer housing 12 may be provided with a second identifier, and the first identifier can match the second identifier. Specifically, the first identifier and the second identifier may jointly form a complete pattern, or the first identifier and the second identifier may jointly form a word or character combination having a specific meaning. Certainly, the first identifier and the second identifier may take other forms, as long as it is convenient for an operator to quickly match the unlocking member 4 according to the outer housing 12, which will not be illustrated here.

Optionally, as regards multiple different first components 1, it is feasible to provide each unlocking member 4 with the same color as an outer housing 12 of a respective first component 1 to quickly select the each unlocking member 4 that matches the respective first component 1. Certainly, in other embodiments, the first component 1 and the matching unlocking member 4 may be provided with other identical identifiers to improve efficiency, for example, stickers of the same color, stickers with matching patterns, or other identifiers which facilitates the quick selection of the matching unlocking member 4 according to the outer housing 12.

Optionally, the engaging protrusion 44 and the receiving groove 123 may be shaped such that a first component 1 can be disengaged from a second component 2 only when unlocked by a matching unlocking member 4. Exemplarily, the engaging protrusion 44 and the receiving groove 123 are each rectangular, or the engaging protrusion 44 and the receiving groove 123 are each hemispherical, or the engaging protrusion 44 and the receiving groove 123 are each semi-circular, as long as a first component 1 can be disengaged from a second component 2 only when unlocked by a matching unlocking member 4, which is not illustrated here.

Optionally, the engaging protrusion 44 and the receiving groove 123 may be positioned such that a first component 1 can be disengaged from a second component 2 only when unlocked by a matching unlocking member 4. Exemplarily, if the receiving groove 123 is disposed in the left end, the middle or the right end of the sidewall of the outer housing 12, then the unlocking can be implemented only when the engaging protrusion 44 of the unlocking member 4 is correspondingly disposed at the left end, the middle or the right end of the unlocking member 4. Certainly, the unlocking member 4 cannot unlock the first component 1 as long as there is a positional error between the engaging protrusion 44 and the receiving groove 123. Therefore, positions of the locking projection 44 and the receiving groove 123 are not limited to the above three examples, which are not illustrated here.

Optionally, the numbers of the engaging protrusion 44 and the receiving groove 123 may be provided such that a first component 1 can be disengaged from a second component 2 only when unlocked by a matching unlocking member 4. Exemplarily, there may be one engaging protrusion 44 and one receiving groove 123, or two engaging protrusions 44 and two receiving grooves 123, or three engaging protrusions 44 and three receiving grooves 123, or four engaging protrusions 44 and four receiving grooves 123, or the like.

Optionally, if the first component 1 has been disengaged from the second component 2, the jack 22 of the second component 2 is in an open environment for dust, and thus, the transmission effect of the connector is affected. To solve this problem, the connector assembly provided in this embodiment further includes a dust cap 5. The dust cap 5 fits the second component 2 to shield the jack 22 of the second component 2.

Figure 11:
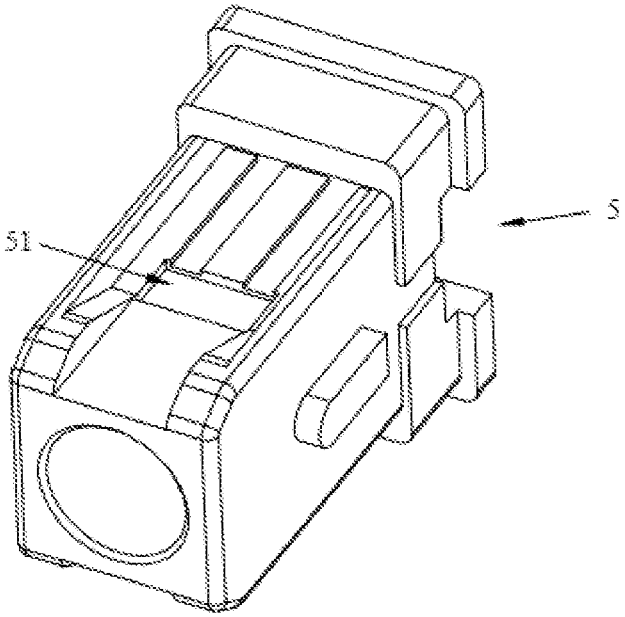
FIG. 11 is a schematic structure view of a dust cap according to the present disclosure.
Figure 12:
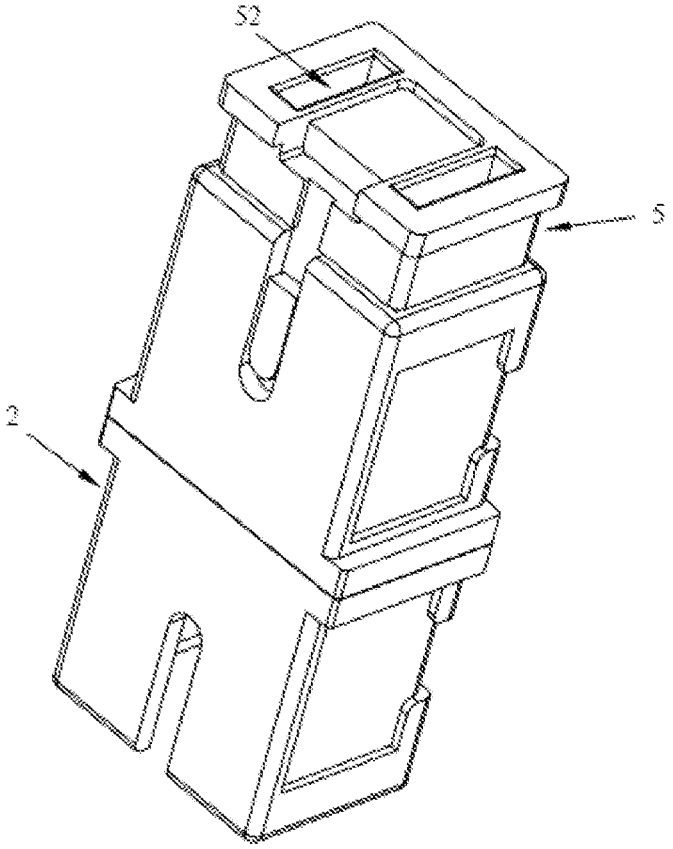
FIG. 12 is a schematic structure view of the first component assembled with the dust cap according to the present disclosure.
Figure 13:
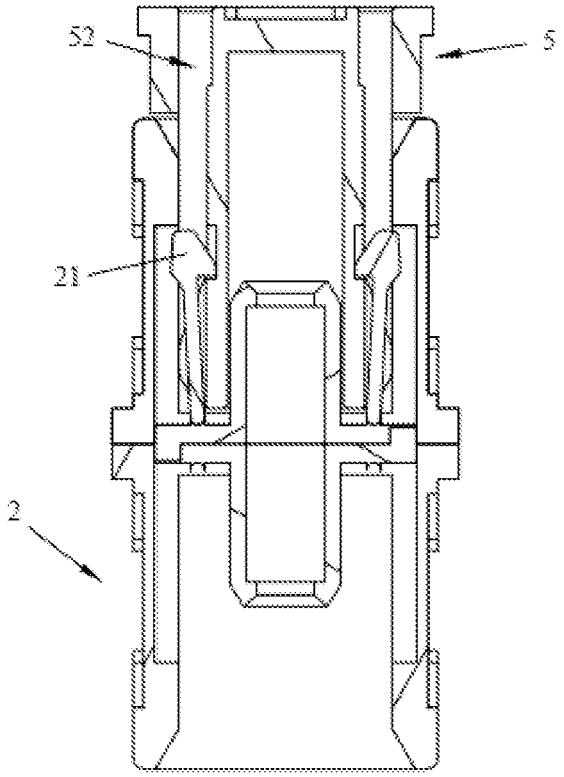
FIG. 13 is a cross-sectional view of the first component assembled with the dust cap according to the present disclosure.

Exemplarily, as shown in FIGS. 11 to 13, the dust cap 5 is provided with a second snap-fit groove 51. The second snap-fit groove 51 is configured to engage with the snap-fit hook 21 of the second component 2 in a snap-fit way so as to secure the dust cap 5 to the second component 2.

Optionally, the second snap-fit groove 51 and the snap-fit hook 21 are in planar contact so that the snap-fit hook 21 cannot be disengaged from the second snap-fit groove 51 in response to only a pull force. That is, the dust cap 5 cannot be pulled out of the second component 2.

Optionally, to pull the dust cap 5 out of the second component 2, the dust cap 5 is provided with an unlocking groove 52. The unlocking arm 41 is configured to be inserted into the unlocking groove 52 and abut against the snap-fit hook 21 so as to disengage the snap-fit hook 21 from the second snap-fit groove 51.

Optionally, as shown in FIG. 13 in conjunction with FIG. 10, the unlocking arm 41 is provided with a second ramp 43.

The second ramp 43 is configured to abut against the snap-fit hook 21 of the second component 2 so as to disengage the snap-fit hook 21 from the second snap-fit groove 51.

In this embodiment, the unlocking arm 41 has a trapezoidal end, two sides of the unlocking arm 41 are each provided with a first ramp 42, and an outer surface of the unlocking arm 41 is provided with the second ramp 43.

Optionally, an inner surface of the unlocking arm 41 is provided with a guide block, and an outer wall of the dust cap 5 is provided with a guide groove. The guide block fits in the guide groove so that the unlocking arm 41 can move stably along the guide groove.

It is to be noted that the above are merely alternative embodiments of the present disclosure and the technical principles used therein. It is to be understood by those skilled in the art that the present disclosure is not limited to the embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A connector assembly comprising a first component and a second component, wherein the first component comprises an inner housing and an outer housing, the outer housing is sleeved on the inner housing, the second component is configured to engage with the first component in a snap-fit way, and the outer housing is movable relative to the inner housing so that the second component is disengageable from the first component, the connector assembly further comprising:

a locking assembly, which comprises two locking grooves oppositely disposed on one of the inner housing and the outer housing, and two locking arms oppositely disposed on the other one of the inner housing and the outer housing, a free end of each of the two locking arms is provided with a locking hook and two protrusions, wherein the locking hook is capable of engaging with a respective one of the two locking grooves in a snap-fit way to secure the outer housing to the inner housing; and an unlocking member, which comprises two unlocking arms oppositely disposed, wherein two sides of an end of each of the two unlocking arms are respectively provided with two first ramps, wherein the unlocking member is configured to be inserted into the first component, so that the two first ramps is able to respectively abut against two protrusions on the same sides of the two different locking arms.

2. The connector assembly according to claim 1, wherein the unlocking member is provided with an engaging protrusion, the outer housing is provided with a receiving groove, and the engaging protrusion is configured such that when the engaging protrusion engages with the receiving groove, the two unlocking arms are capable of propping the two locking arms open to disengage the two locking hooks from the two locking grooves.

3. The connector assembly according to claim 1, further comprising a dust cap, wherein the dust cap is provided with two second snap-fit grooves, the second component is provided with two snap-fit hooks, and the two second snap-fit grooves are configured to engage with the two snap-fit hooks of the second component in a snap-fit way so as to secure the dust cap to the second component.

4. The connector assembly according to claim 3, wherein the dust cap is provided with two unlocking grooves, and the two unlocking arms are configured to be inserted into the two unlocking grooves and abut against the two snap-fit hooks so as to disengage the two snap-fit hooks from the two second snap-fit grooves.

5. The connector assembly according to claim 4, wherein each of the two unlocking arms is provided with a second ramp, and the second ramp is configured to abut against a respective one of the two snap-fit hooks so as to disengage the two snap-fit hooks from the two second snap-fit grooves.

* * * * *